US007229322B2

(12) United States Patent
Bangert

(10) Patent No.: US 7,229,322 B2
(45) Date of Patent: Jun. 12, 2007

(54) OUTLET EXTENSION UNIT AND DESIGNER OUTLET COVER

(76) Inventor: Brian D. Bangert, P.O. Box 65, Westmoreland, CA (US) 92281

( * ) Notice: Subject to any disclaimer, the term of this patent is extended or adjusted under 35 U.S.C. 154(b) by 0 days.

(21) Appl. No.: 11/302,074

(22) Filed: Dec. 12, 2005

(65) Prior Publication Data

US 2006/0172607 A1 Aug. 3, 2006

(51) Int. Cl.
*H01R 25/00* (2006.01)

(52) U.S. Cl. ..... 439/638; 439/652; 439/131; 439/134; 439/13

(58) Field of Classification Search ..... 439/638, 439/652, 13, 131, 134–136; 174/66, 67
See application file for complete search history.

(56) References Cited

U.S. PATENT DOCUMENTS

| | | | | |
|---|---|---|---|---|
| D267,226 | S | 12/1982 | Oster | |
| D307,538 | S | 5/1990 | Tyree | |
| D308,814 | S | 6/1990 | Kintigos et al. | |
| 5,078,614 | A | 1/1992 | Shotey | |
| 5,165,042 | A | 11/1992 | Klinger | |
| 5,212,347 | A | 5/1993 | Powers et al. | |
| 5,285,014 | A | 2/1994 | Gilchrist | |
| D346,361 | S | 4/1994 | Richey et al. | |
| 5,375,728 | A | 12/1994 | West | |
| D360,878 | S | 8/1995 | Dyer et al. | |
| 5,525,755 | A | 6/1996 | Christensen | |
| 5,723,816 | A | 3/1998 | Neece | |
| 5,747,738 | A | 5/1998 | Indoe | |
| 5,934,919 | A | 8/1999 | Cross et al. | |
| 6,031,183 | A | 2/2000 | Guerrieri | |
| 6,118,643 | A * | 9/2000 | Dyer et al. | 361/111 |
| 6,457,843 | B1 * | 10/2002 | Kester et al. | 362/276 |
| 6,642,450 | B1 * | 11/2003 | Hsiao | 174/53 |
| 6,664,471 | B1 | 12/2003 | Howe, Jr. | |
| 6,709,297 | B2 * | 3/2004 | Lee | 439/638 |
| 6,916,989 | B2 | 7/2005 | Broussard, Jr. | |
| 6,977,342 | B1 * | 12/2005 | Maltby et al. | 174/66 |
| 2002/0182936 | A1 * | 12/2002 | Fowler | 439/652 |
| 2003/0106703 | A1 * | 6/2003 | Wilson | 174/66 |

* cited by examiner

*Primary Examiner*—Tho D. Ta
(74) *Attorney, Agent, or Firm*—Joseph E. Mueth

(57) ABSTRACT

An outlet extension unit adapted to plug into a conventional electrical wall outlet with wall plate comprising:

a member having an upper end and a lower end, on one side at least one pair of outwardly projecting electrically conductive prongs adapted to plug into said conventional wall outlet and at least partially cover said wall plate, said prongs being in electric conducting communication with a rotatable electrical receptacle carried at said lower end which is adapted to receive at least one conventional plug of an electrical device, said extension unit having at least one pair of electrically non-conductive prong receiving openings therein on the side opposite said outwardly projecting electrically conductive prongs.

The outlet extension unit as just described is intended to be used in conjunction with a novel designer outlet cover comprising a member adapted to at least substantially enclose said extension unit and wall outlet, said designer outlet cover having at least one pair of electrically non-conductive prongs on one surface thereof which plug into said prongs receiving openings and thereby hold the designer outlet cover to said outlet extension unit, the opposite surface of said designer outlet cover having a decorative finish.

The decorative finish is preferably intended to match the surface of the backsplash in which the electrical wall outlet is mounted.

6 Claims, 7 Drawing Sheets

OUTLET EXTENSION UNIT AND DESIGNER OUTLET COVER

BACKGROUND OF INVENTION

The following prior art is of possible relevance to the invention described hereinbelow.

| Patent Number | Inventor |
|---|---|
| 5,375,728 | West |
| 5,165,042 | Klinger |
| Des. 308,814 | Kintigos et al. |
| Des. 307,538 | Tyree |
| Des. 267,226 | Oster |
| Des. 360,878 | Dyer et al. |
| 5,285,014 | Gilchrist |
| 5,525,755 | Christensen |
| 5,723,816 | Neece |
| 6,664,471 B1 | Howe, Jr. |
| Des. 346,361 | Richey et al. |
| 5,078,614 | Shotey |
| 5,212,347 | Powers et al. |
| 5,934,919 | Cross et al. |
| 6,031,183 | Guerrieri |
| 6,916,989 | Broussard, Jr. |
| 5,747,738 | Indoe |

SUMMARY OF INVENTION

An outlet extension unit adapted to plug into a conventional electrical wall outlet with wall plate comprising:

a member having an upper end and a lower end, on one side at least one pair of outwardly projecting electrically conductive prongs adapted to plug into said conventional wall outlet and at least partially cover said wall plate, said prongs being in electric conducting communication with a rotatable electrical receptacle carried at said lower end which is adapted to receive at least one conventional plug of an electrical device, said extension unit having at least one pair of prong receiving openings therein on the side opposite said outwardly projecting electrically conductive prongs.

The outlet extension unit as just described is intended to be used in conjunction with a novel designer outlet cover comprising a member adapted to at least substantially enclose said extension unit and wall outlet, said designer outlet cover having at least one pair of non-conductive prongs on one surface thereof which plug into said prongs receiving openings and thereby hold the designer outlet cover to said outlet extension unit, the opposite surface of said designer outlet cover having a decorative finish.

The decorative finish is preferably intended to match the surface of the back splash in which the electrical wall outlet is mounted.

Figure 2A:
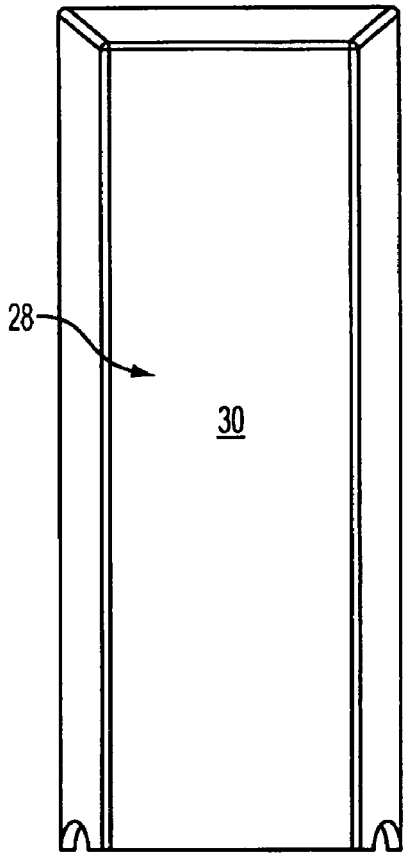
FIG. 2 shows the front view (FIG. 2A), side view (FIG. 2B), and top view (FIG. 2C) of the designer outlet cover.
Figure 2B:
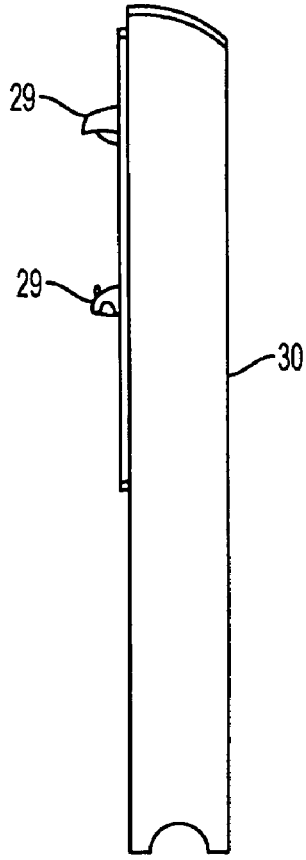
Figure 2C:
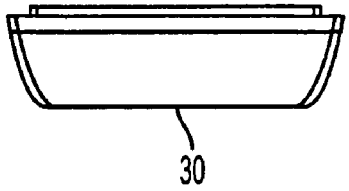
Figure 3A:
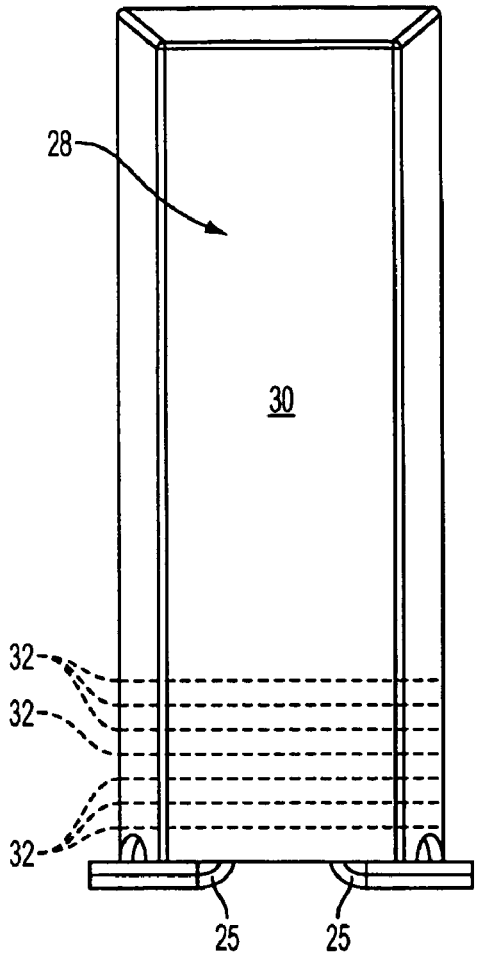
Figure 3B:
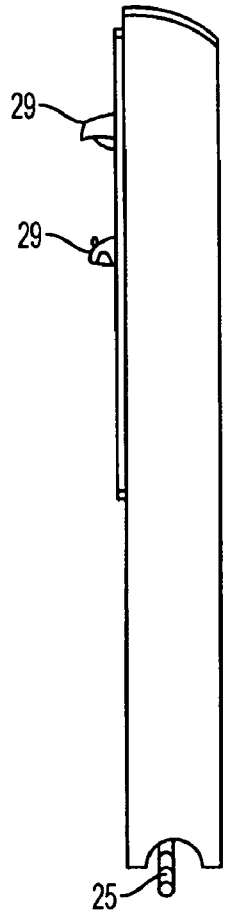
Figure 3C:
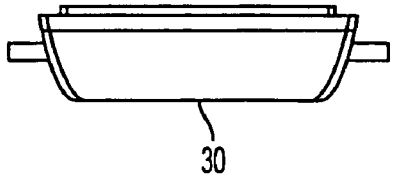

FIG. 3 shows the designer outlet cover of FIG. 2 as it is intended to cover the wall outlet and extension unit. FIG. 3A is the front view, FIG. 3B is the side view and FIG. 3C is the top view. This Figure (FIG. 3A) also shows the thin grooves which facilitate the removal of any portion of the length of the designer cover so that the lower end of the designer cover can be made to abut or nearly abut the horizontal counter top.

Figure 1:
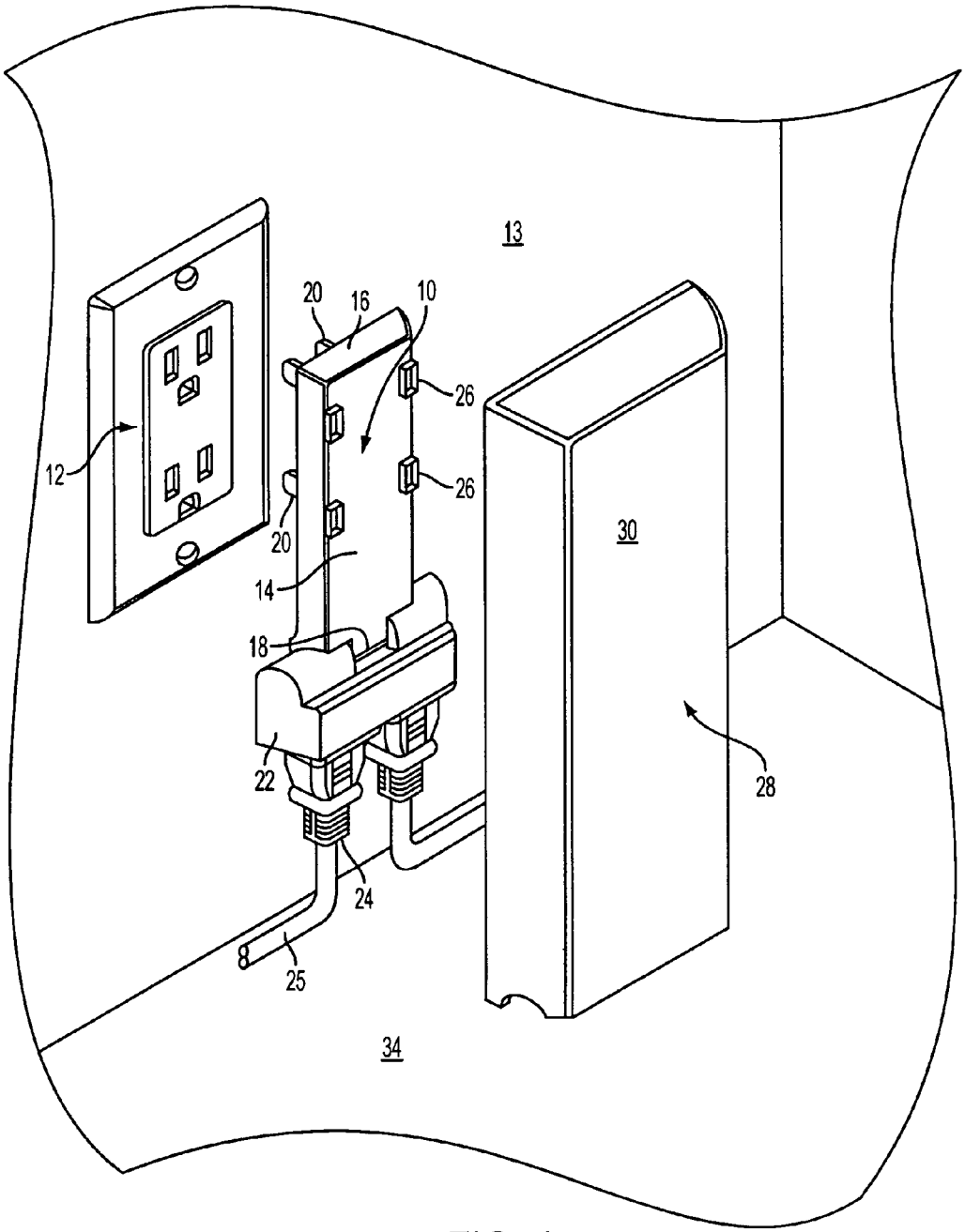
FIG. 1 is a perspective unit showing a conventional electrical wall outlet in a backsplash, the extension unit and the designer outlet cover, the parts being aligned to be assembled into the intended assembly.
Figure 4:
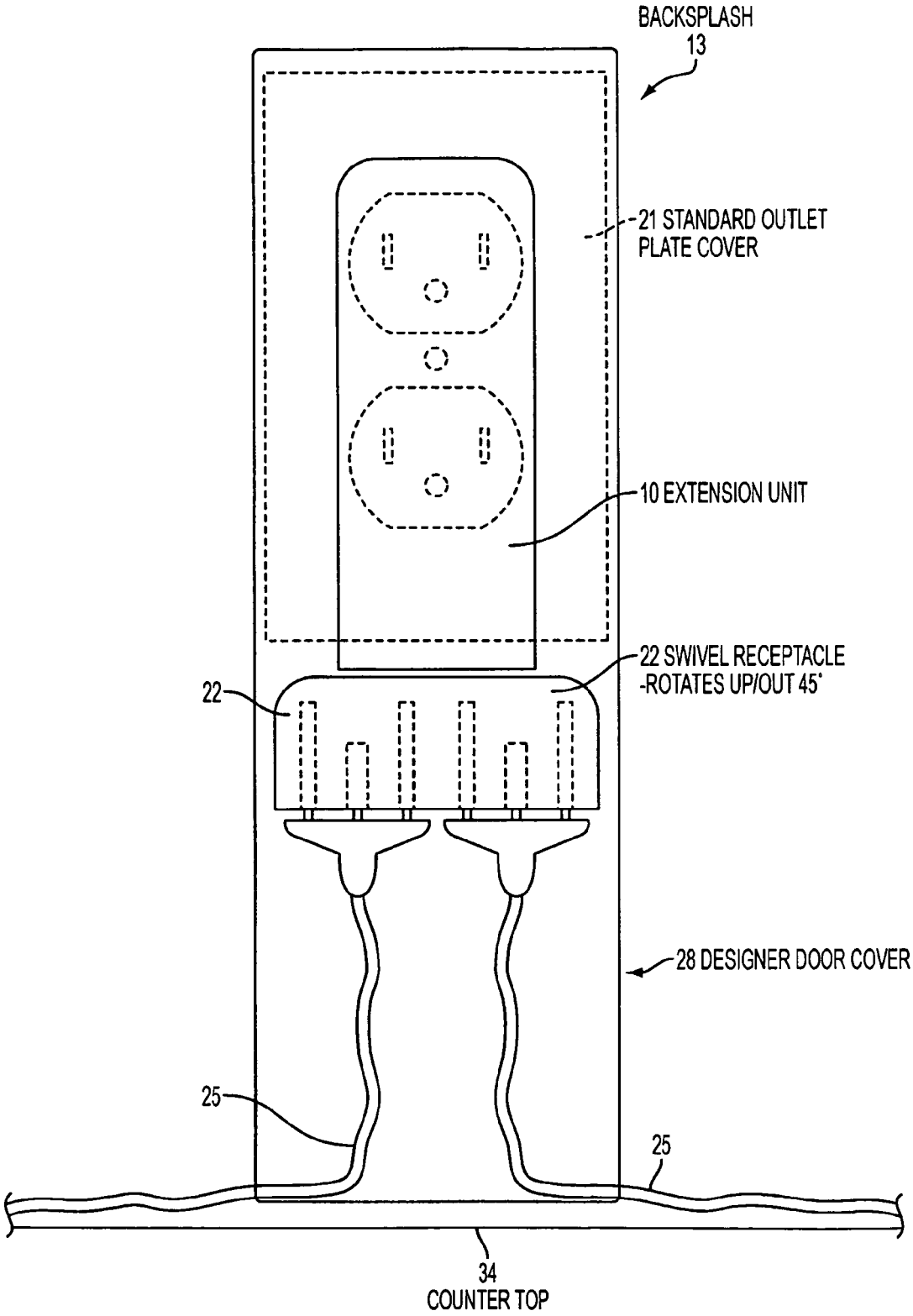

FIG. 4 is a front view showing the parts of FIG. 1 as assembled.

Figure 5:
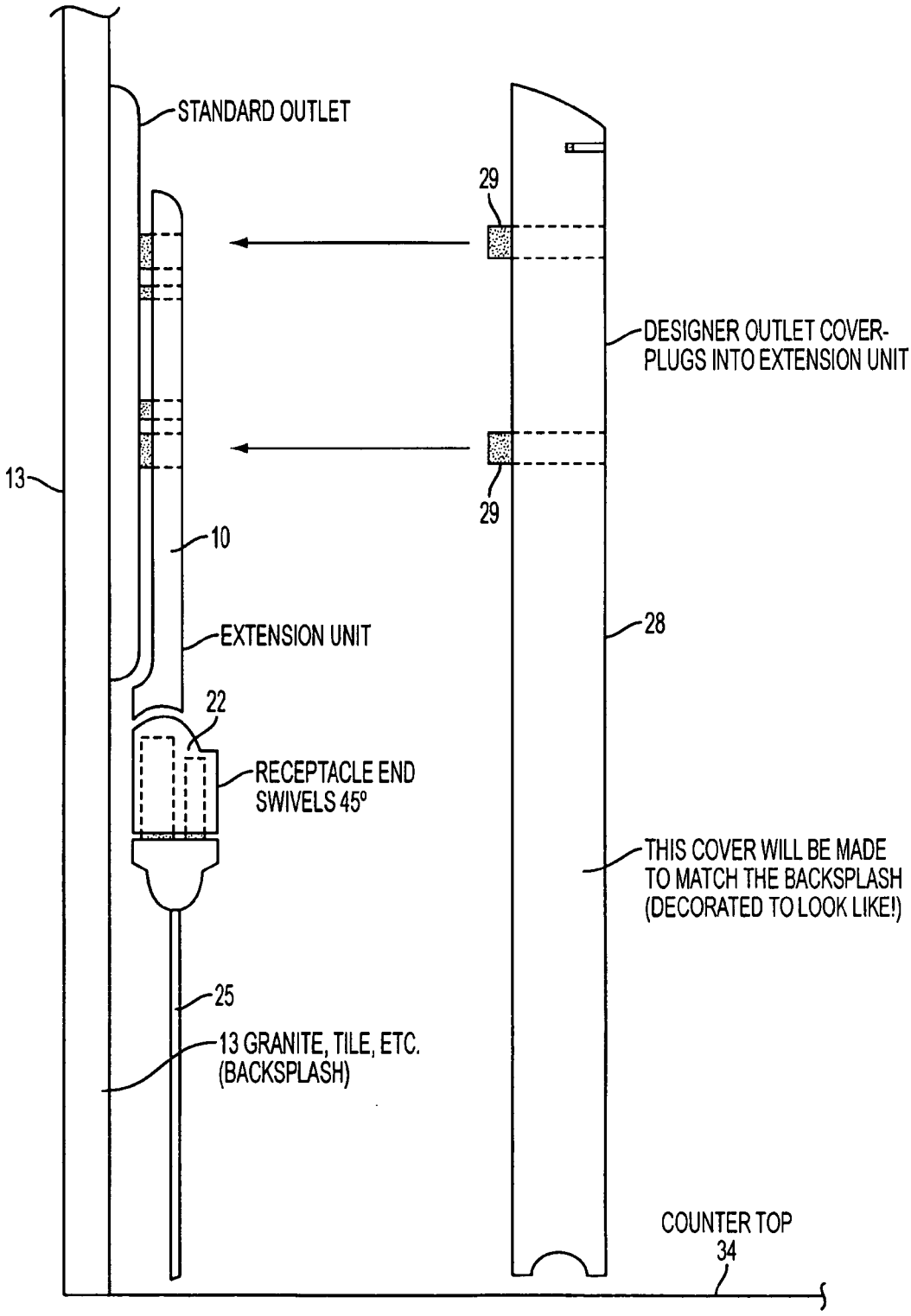

FIG. 5 is a side view of the parts of FIG. 4 with the designer outlet cover unplugged and spaced apart from the outlet extension unit for purposes of illustration.

Figure 6:
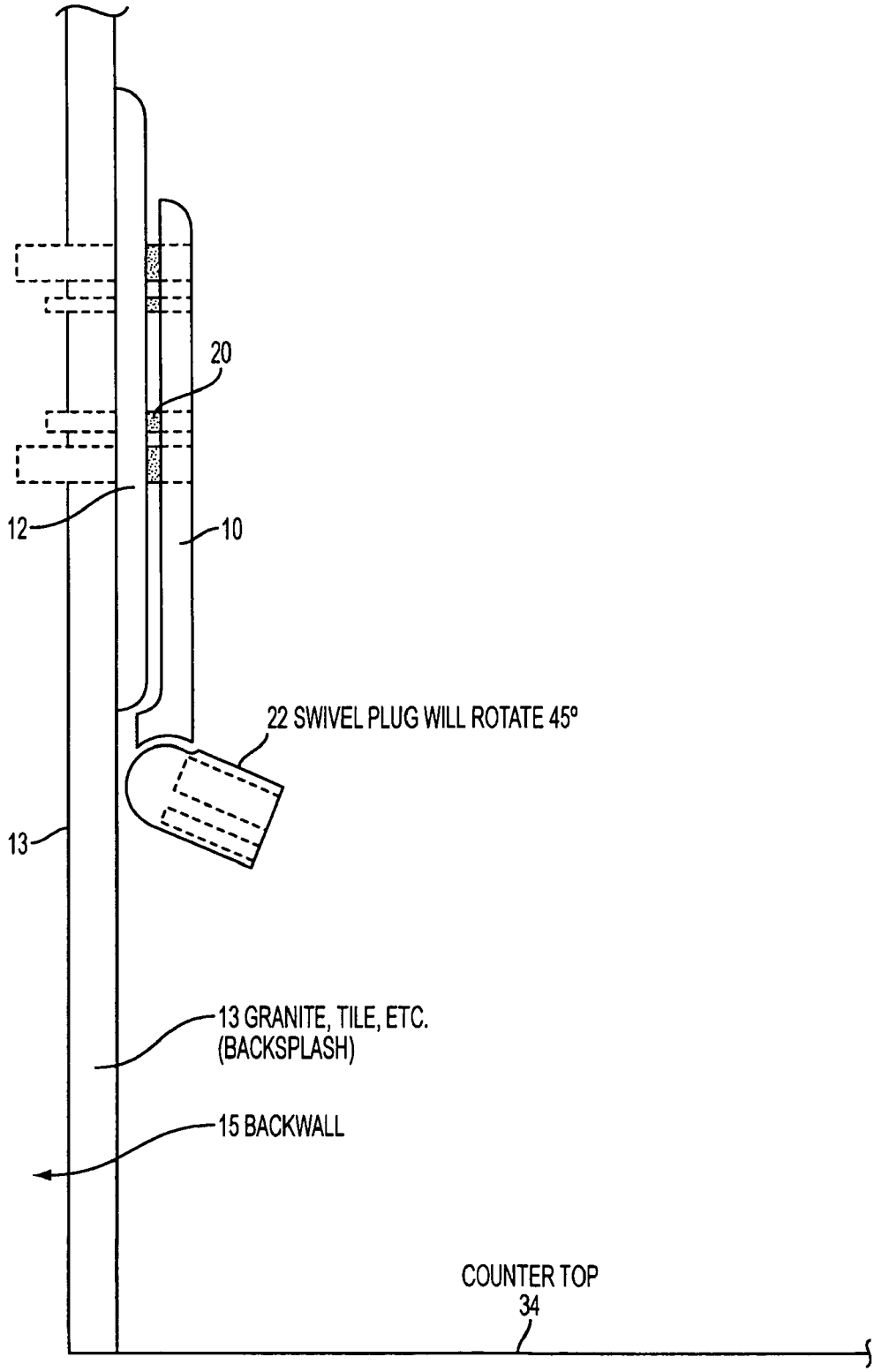

FIG. 6 is a side view showing the designer cover removed and the rotatable electrical receptable rotated outwardly to about a 45° angle.

Figure 7:
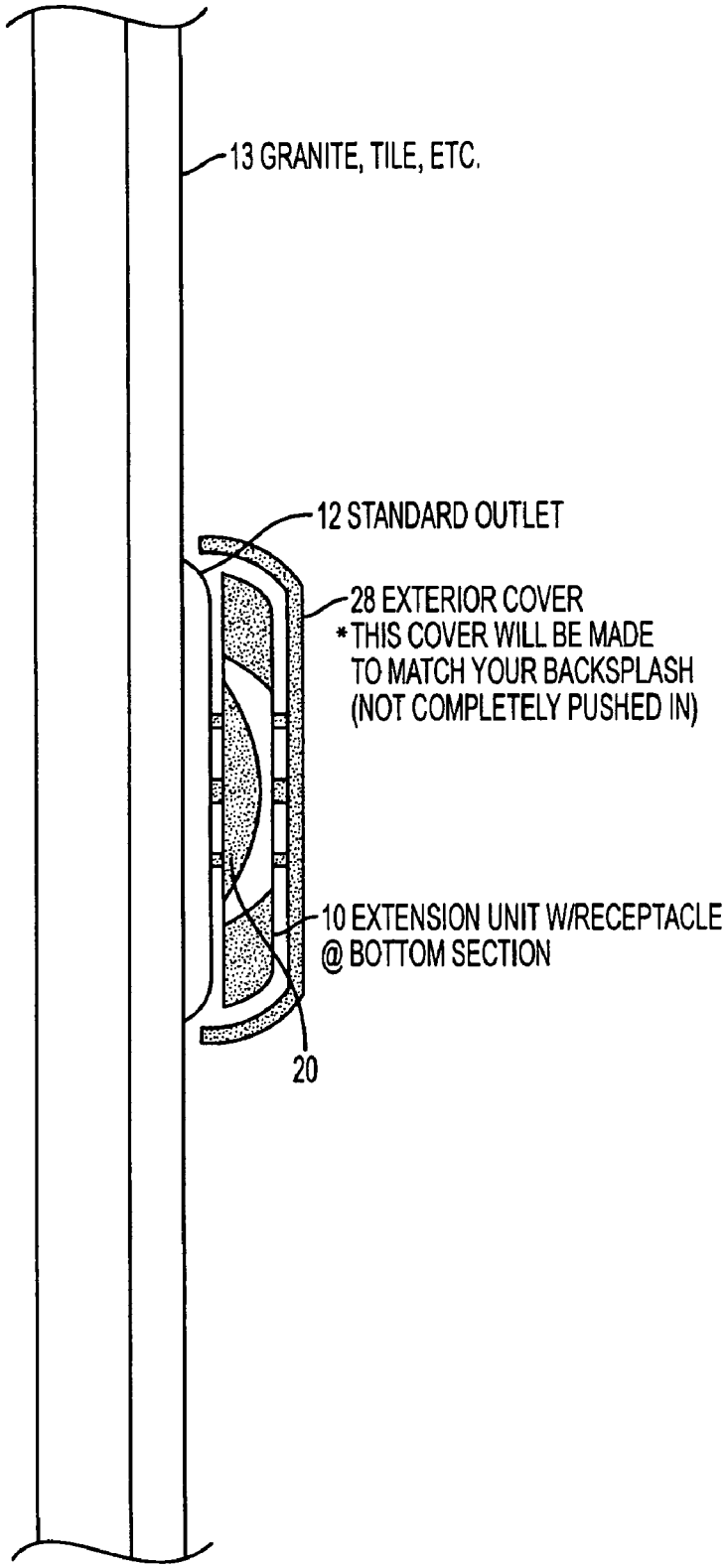

FIG. 7 is a top view of the arrangement shown in FIG. 6.

DESCRIPTION OF PREFERRED EMBODIMENTS

The outlet extension unit 10 is adapted to plug into a conventional electrical wall outlet 12 and comprises member 14 having an upper end 16 and a lower end 18. The electrical wall outlet 12 is located in a wall such as backsplash 13. The backsplash typically is decorative such as a relatively thin sheet of granite adhered to the basic wall structure 15. One side of member 14 has at least one pair of outwardly projecting conductive prongs 20 adapted to plug into said conventional wall outlet 12. The prongs 20 are in electric conducting communication with a rotatable electrical receptacle 22 at said lower end 18 adapted to receive a conventional plug 24 having wires 25 connected to any electrical device (not shown), said outlet extension unit 10 having two pairs of plug receiving openings 26 therein on the side opposite said outwardly projecting prongs 20.

The conventional electrical wall outlet 12 normally has a standard outlet plate cover 21.

The rotatable electrical receptacle 22 is adapted to swivel out to about 45°.

The outlet extension unit 10 as just described is intended to be used in conjunction with a designer outlet cover 28 comprising a member adapted to cover and enclose said outlet extension unit 10, said designer outlet cover 28 having a pair of non-conductive plugs 29 on one surface thereof which plug into said plug receiving openings 26 and thereby hold the designer outlet cover to said extension unit 10. The opposite surface 30 of said designer outlet cover is adapted to have a decorative finish such as tile, granite, Corians, cultured marble, etc.

The decorative surface 30 is preferably intended to match the surface of the back splash 13 in which the electrical outlet is mounted.

The designer outlet cover 28 preferably has on the inside lower portion, thin grooved out lines 32 that will be horizontal from one side to the other.

This will allow the use of a razor knife to cut the inside of any groove 32 and thereby remove material and make the cover 28 any length desired. The covers 28 can be obtained in standard lengths, example 8, 10, 12, 14 and 16 inch lengths. Normally the length is adapted to extend almost to or all the way to the horizontal counter top 34.

The invention claim is:

1. An outlet extension unit adapted to plug into a conventional electrical wall outlet with wall plate comprising:

a member having an upper end and a lower end, on one side at least one pair of outwardly projecting electrically conductive prongs adapted to plug into said conventional wall outlet and at least partially cover said wall plate, said prongs being in electric conducting communication with a rotatable electrical receptacle carried at said lower end which is adapted to receive at least one conventional plug of an electrical device, said extension unit having at least one pair of electrically non-conductive prong receiving openings therein on the side opposite said outwardly projecting electrically conductive prongs.

2. The combination comprising:

(1) an outlet extension unit adapted to plug into a conventional electrical wall outlet with wall plate comprising:

a member having an upper end and a lower end, on one side at least one pair of outwardly projecting electrically conductive prongs adapted to plug into said conventional wall outlet and at least partially cover said wall plate, said prongs being in electric conducting communication with a rotatable electrical receptacle carried at said lower end which is adapted to receive at least one conventional plug of an electrical device, said extension unit having at least one pair of electrically non-conductive prong receiving openings therein on the side opposite said outwardly projecting electrically conductive prongs and (2) a designer outlet cover comprising member adapted to at least substantially enclose said extension unit, said designer outlet cover having at least one pair of non-conductive prongs on one surface thereof plugged into said prong receiving openings to thereby hold said designer outlet cover to said outlet extension unit.

3. The combination of claim 2 wherein the designer outlet cover has a surface opposite the surface having non-conductive prongs, said opposite surface having a decorative finish.

4. The combination of claim 3 wherein said combination is plugged into a conventional electrical wall outlet.

5. The combination of claim 4 wherein said wall outlet is mounted in a wall which provides a backsplash.

6. The combination of claim 5 wherein said decorative finish matches the surface of the backsplash in which the electrical outlet is mounted.

* * * * *

UNITED STATES PATENT AND TRADEMARK OFFICE

CERTIFICATE OF CORRECTION

PATENT NO. : 7,229,322 B2
APPLICATION NO. : 11/302074
DATED : June 12, 2007
INVENTOR(S) : Brian D. Bangert It is certified that error appears in the above-identified patent and that said Letters Patent is hereby corrected as shown below:

Erroneously omitted, as set forth in the Declaration and Power of Attorney for Patent Application, page 2, filed December 12, 2005:

To be inserted on the title page:

Related U.S. Application Data

(60) Provisional application No. 60/635,811, filed on December 13, 2004.

To be inserted at column 1, line 6:

This patent claims the filing date of U.S. Provisional Patent Application Ser. No. 60/635,811, filed December 13, 2004, the disclosures of which are incorporated herein by reference.

Signed and Sealed this

Seventh Day of August, 2007

JON W. DUDAS
*Director of the United States Patent and Trademark Office*